US010486284B2

(12) United States Patent
Togashi et al.

(10) Patent No.: US 10,486,284 B2
(45) Date of Patent: Nov. 26, 2019

(54) SUBSTRATE HOLDING DEVICE, AND SUBSTRATE POLISHING APPARATUS

(71) Applicant: Ebara Corporation, Tokyo (JP)

(72) Inventors: Shingo Togashi, Tokyo (JP); Hozumi Yasuda, Tokyo (JP); Makoto Fukushima, Tokyo (JP); Osamu Nabeya, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 255 days.

(21) Appl. No.: 15/292,325

(22) Filed: Oct. 13, 2016

(65) Prior Publication Data

US 2017/0106497 A1 Apr. 20, 2017

(30) Foreign Application Priority Data

Oct. 14, 2015 (JP) ..... 2015-203262

(51) Int. Cl.
*B24B 37/32* (2012.01)
*B24B 37/20* (2012.01)

(52) U.S. Cl.
CPC ..... *B24B 37/32* (2013.01); *B24B 37/20* (2013.01)

(58) Field of Classification Search
CPC ..... B24B 37/30; B24B 37/32
See application file for complete search history.

(56) References Cited

U.S. PATENT DOCUMENTS 5,643,061 A * 7/1997 Jackson ..... B24B 37/30 451/288
6,110,025 A * 8/2000 Williams ..... B24B 49/16 451/286
6,116,992 A * 9/2000 Prince ..... B24B 37/32 156/345.14
6,368,189 B1 * 4/2002 Maloney ..... B24B 37/30 451/288
6,443,820 B2 * 9/2002 Kimura ..... B24B 37/30 451/285
6,517,422 B2 * 2/2003 Sakamoto ..... B24B 37/32 451/288
7,029,386 B2 * 4/2006 Young ..... B24B 37/32 451/285
7,344,434 B2 * 3/2008 Chen ..... B24B 37/32 451/285
2001/0053665 A1 * 12/2001 Lee ..... B24B 37/32 451/288

(Continued)

FOREIGN PATENT DOCUMENTS

JP 2005-011999 A 1/2005
JP 2007-027166 A 2/2007

(Continued)

*Primary Examiner* — Timothy V Eley
(74) *Attorney, Agent, or Firm* — Abelman, Frayne & Schwab

(57) ABSTRACT

Provided is a substrate holding device used in a substrate polishing apparatus that polishes a substrate using a polishing pad. The substrate holding device includes: a retainer ring configured to hold a peripheral edge of the substrate; and a drive ring fixed to the retainer ring so as to rotate together with the retainer ring. The surface of the retainer ring at the polishing pad side has a convex portion at a position other than an innermost circumference following a shape of the drive ring.

11 Claims, 10 Drawing Sheets

(56) References Cited

U.S. PATENT DOCUMENTS

| | | | | |
|---|---|---|---|---|
| 2007/0298693 | A1* | 12/2007 | Ichinoshime | B24B 37/32 451/285 |
| 2013/0035022 | A1* | 2/2013 | Paik | B24B 37/32 451/364 |

FOREIGN PATENT DOCUMENTS

| | | | |
|---|---|---|---|
| JP | 2007-511377 | A | 5/2007 |
| JP | 2007-296603 | A | 11/2007 |

* cited by examiner

SUBSTRATE HOLDING DEVICE, AND SUBSTRATE POLISHING APPARATUS

CROSS-REFERENCE TO RELATED APPLICATIONS

This application is based on and claims priority from Japanese Patent Application No. 2015-203262, filed on Oct. 14, 2015, with the Japan Patent Office, the disclosure of which is incorporated herein in its entirety by reference.

TECHNICAL FIELD

The present disclosure relates to a substrate holding device that holds a substrate, a substrate polishing apparatus that includes the substrate holding device, and a method of manufacturing the substrate holding device.

BACKGROUND

In a manufacturing process of semiconductor devices, a substrate polishing apparatus has been widely used for polishing the surface of a wafer. The substrate polishing apparatus holds the peripheral edge of the wafer with an annular retainer ring and presses the wafer against a polishing pad, thereby performing a polishing.

As the retainer ring is a consumable part that is worn out when the wafer is polished, it needs to be regularly exchanged with a new one. In addition, the polishing characteristic of a new retainer ring is not stabilized right after the exchange, and thus, the new retainer ring is generally initialized by polishing a dummy wafer.

See, for example, Japanese Patent Laid-Open Publication Nos. 2005-11999, 2007-27166, 2007-296603, and 2007-511377.

SUMMARY

According to one aspect of the present disclosure, there is provided a substrate holding device for use in a substrate polishing apparatus that polishes a substrate using a polishing pad. The substrate holding device includes: a retainer ring configured to hold a peripheral edge of the substrate; and a drive ring fixed to the retainer ring so as to rotate together with the retainer ring. The surface of the retainer ring at the polishing pad side has a convex portion at a position other than an innermost circumference following a shape of the drive ring.

The foregoing summary is illustrative only and is not intended to be in any way limiting. In addition to the illustrative aspects, embodiments, and the features described above, further aspects, embodiments, and features will become apparent by reference to the drawings and the following detailed description.

BRIEF DESCRIPTION OF THE DRAWINGS

FIG. 1A, and FIGS. 1B1 to 1B3 are views each schematically illustrating a cross-section of a top ring 100 (a substrate holding device) and a polishing pad 2 in a substrate polishing apparatus.

FIG. 3 is a view schematically illustrating a substrate polishing apparatus.

DETAILED DESCRIPTION

Figure 1A:
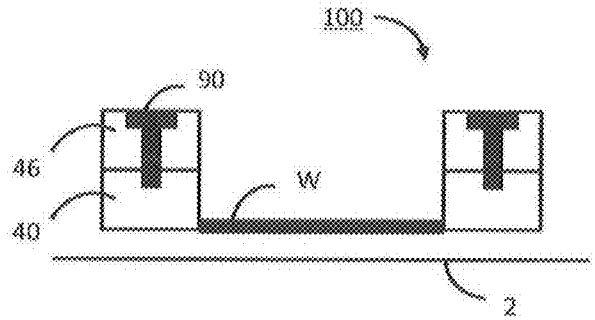
Figure 1A:
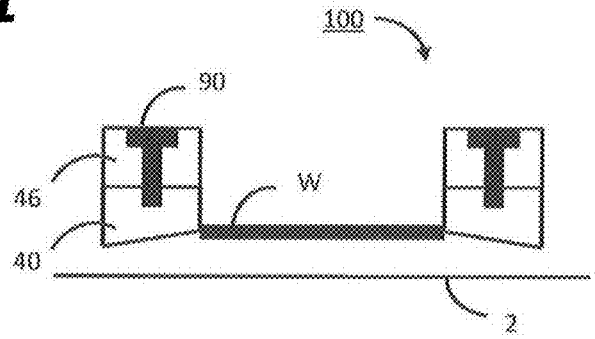
Figure 1A:
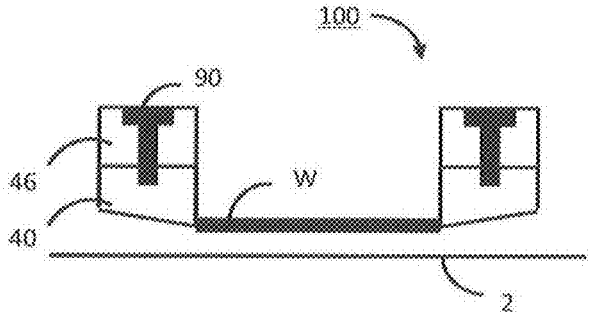
Figure 1A:
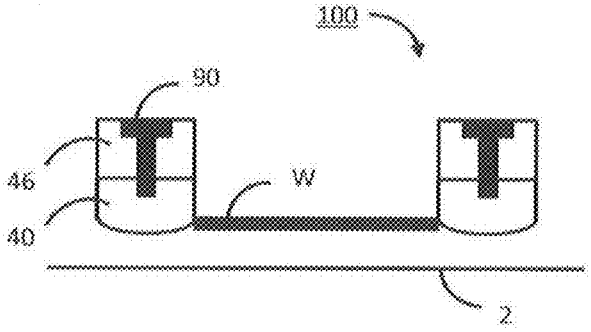

In the following detailed description, reference will be made to the accompanying drawings, which form a part hereof. The exemplary embodiments described in the detailed description, drawings, and claims are not meant to be limiting. Other embodiments may be utilized, and other changes may be made without departing from the spirit or scope of the subject matter presented here.

Initializing a retainer ring using a dummy wafer is a process that does not contribute to production. Thus, it is desirable to shorten the initializing process as much as possible, and it is more desirable if the initializing process can be eliminated.

The present disclosure has been made in consideration of these problems, and an object of the present disclosure is to provide a substrate holding device capable of obtaining a stable polishing characteristic from an initial period, a substrate polishing apparatus including the substrate holding device, and a method for manufacturing the substrate holding device.

According to one aspect of the present disclosure, there is provided a substrate holding device for use in a substrate polishing apparatus that polishes a substrate using a polishing pad. The substrate holding device includes: a retainer ring configured to hold a peripheral edge of the substrate; and a drive ring fixed to the retainer ring to rotate together with the retainer ring. The surface of the retainer ring at a polishing pad side has a convex portion at a position other than an innermost circumference due to a shape of the drive ring.

With this configuration, the surface of the retainer ring at the polishing pad side may be formed into a desired shape from the beginning by the shape of the drive ring. For that reason, the substrate polishing characteristic may be stabilized even with an initial retainer ring that has been newly exchanged. Meanwhile, the shape of the convex portion is not particularly limited, and may be a rectangular shape, a curved shape, or a shape inclined such that the end of the retainer ring becomes an apex.

According to another aspect of the present disclosure, there is provided a substrate holding device for use in a substrate polishing apparatus that polishes a substrate using a polishing pad. The substrate holding device includes: a retainer ring including an inner retainer ring configured to hold a peripheral edge of the substrate and an outer retainer ring provided outside the inner retainer ring; and a drive ring fixed to the retainer ring to rotate together with the retainer ring. The surface of the inner retainer ring and/or the surface of the outer retainer ring at the polishing pad side have a convex portion due to a shape of the drive ring.

With this configuration, even in a case where the retainer ring including the inner retainer ring and the outer retainer ring is used, the surface of the retainer ring at the polishing pad side may also be formed into a desired shape from the beginning by the shape of the drive ring.

Specifically, the drive ring is fixed to the retainer ring at a side opposite to the polishing pad, and the surface of the drive ring at the retainer ring side has a convex portion at a position other than an innermost circumference thereof, and as a result the surface of the retainer ring at the polishing pad side has a convex portion.

In addition, according to another aspect of the present disclosure, there is provided a substrate holding device for use in a substrate polishing apparatus that polishes a substrate using a polishing pad. The substrate holding device includes: a retainer ring configured to hold a peripheral edge of the substrate; a drive ring fixed to the retainer ring to rotate together with the retainer ring; and a ring-type annular member configured, substantially over an entire circumference thereof, to be in contact with the drive ring at one portion thereof and to be in contact with the retainer ring at another portion thereof. The surface of the retainer ring at the polishing pad side has a convex portion due to a shape of the annular member.

With this configuration, the surface of the retainer ring at the polishing pad side may be formed into a desired shape from the beginning by the shape of the annular member. For that reason, the substrate polishing characteristic may be stabilized even with an initial retainer ring. Furthermore, because the retainer ring and the drive ring are fixed substantially over the entire circumference thereof, the surface of the retainer ring at the polishing pad side may be made uniform.

The retainer ring may include an inner retainer ring configured to hold a peripheral edge of the substrate, and an outer retainer ring provided outside the inner retainer ring. The surface of the inner retainer ring and/or the surface of the outer retainer ring at the polishing pad side may be made to have a convex portion due to the shape of the annular member.

With this configuration, even in a case where the retainer ring including the inner retainer ring and the outer retainer ring is used, the surface of the retainer ring at the polishing pad side may also be formed into a desired shape from the beginning by the shape of the drive ring.

Specifically, the surface of the retainer ring at the polishing pad side may be made to have a convex portion due to the length of the annular member.

More specifically, the drive ring may be formed with a first inserted portion into which the annular member is inserted, the retainer ring may be formed with a second inserted portion into which the annular member is inserted, and the surface of the retainer ring at the polishing pad side may be made to have a convex portion because the annular member has a length that is longer than a sum of a length of the first inserted portion and a length of the second inserted portion.

This enables the convex portion formed on the surface of the retainer ring at the polishing pad side to be adjusted according to the length of the annular member.

The substrate holding device may further include a fixing member configured to fix the drive ring and the retainer ring substantially over an entire circumference thereof.

By fixing the drive ring and the retainer ring substantially over an entire circumference thereof, the bottom surface of the retainer ring may be made uniform.

The surface of the retainer ring at the polishing pad side may not have a convex portion in a state where the retainer ring is not fixed to the drive ring.

Further, upon being fixed to the drive ring, the retainer ring may be deformed such that the surface of the retainer ring at the polishing pad side has a convex portion.

This enables a general-purpose product to be used as the retainer ring which is a consumable part.

The drive ring may be a non-consumable part and the retainer ring may be a consumable part.

Even in this case, a general-purpose product may be used as the retainer ring, which is a consumable part, by forming the convex portion on the surface of the retainer ring at the polishing pad side by the shape of the drive ring or the fixing member which is a non-consumable part.

According to another aspect, there is provided a substrate polishing apparatus that includes the above-described substrate holding device and the above-described polishing pad.

According to another aspect, there is provided a method of manufacturing a substrate holding device for use in a substrate polishing apparatus that polishes a substrate using a polishing pad. The method includes: providing a retainer ring, as a consumable part, to hold a peripheral edge of the substrate; fixing a drive ring to the retainer ring to rotate together with the retainer ring; and determining a shape of the drive ring according to a shape of the surface of a used retainer ring at the polishing pad side.

With the manufacturing method, when a new retainer ring is fixed to the drive ring, the surface of the retainer ring at the polishing pad side may be made similar to the shape of the surface of the used retainer ring at the polishing pad side, which enables the polishing characteristic of the substrate to be stabilized even with an initial retainer ring.

The shape of the drive ring may be determined such that the shape of the surface of the retainer ring at the polishing pad side becomes similar to the shape of the surface of the used retainer ring at the polishing pad side.

In addition, one drive ring may be selected among a plurality of drive rings, which have been prepared beforehand and have different shapes in such a manner in which the shape of the surface of the retainer ring at the polishing pad side becomes the most similar to the shape of surface of the used retainer ring at the polishing pad side.

According to another aspect, there is provided a method of manufacturing a substrate holding device for use in a substrate polishing apparatus that polishes a substrate using a polishing pad. The method includes: providing a retainer ring, as a consumable part, to hold a peripheral edge of the substrate; fixing a drive ring to the retainer ring to rotate together with the retainer ring; providing a ring-type annular member in such manner in which, substantially over an entire circumference of the annular member, a portion is in contact with the drive ring and another portion is in contact with the retainer ring; and determining a shape of the annular member according to a shape of the surface of a used retainer ring at the polishing pad side.

With the manufacturing method, when a new retainer ring is fixed to the drive ring, the surface of the retainer ring at the polishing pad side may be also made similar to the shape of the surface of the used retainer ring at the polishing pad side, which enables the polishing characteristic of the substrate to be stabilized even with an initial retainer ring.

The shape of the annular member may be determined in such a manner in which the shape of the surface of the retainer ring at the polishing pad side becomes similar to the shape of the surface of the used retainer ring at the polishing pad side.

In addition, one annular member may be selected among a plurality of annular members, which have been prepared beforehand and have different shapes, in such a manner in which the shape of the surface of the retainer ring at the polishing pad side becomes most similar to the shape of the surface of the used retainer ring at the polishing pad side.

A stabilized substrate polishing characteristic may be obtained even with an initial retainer ring.

Descriptions will be made as to the reason why a substrate polishing characteristic is not stabilized in a general top ring right after a retainer ring is exchanged.

FIG. 1A, and FIGS. 1B1 to 1B3 are views each schematically illustrating a cross-section of a top ring 100 (a substrate holding device) and a polishing pad 2 in a substrate polishing apparatus. The top ring 100 includes an annular retainer ring 40 configured to hold the peripheral edge of a substrate W and an annular drive ring 46 configured to rotationally drive the retainer ring 40. The drive ring 46 is fixed to the top side of the retainer ring 40 by a plurality of screws 90 provided at substantially regular intervals in the circumferential direction. Accordingly, the bottom surface of the drive ring 46 is in contact with the top surface of the retainer ring 40.

As illustrated in FIG. 1A, in a common top ring 100, the bottom surface (the surface at the retainer ring 40 side) of either the drive ring 46 or the retainer ring 40 is substantially horizontal (parallel with the polishing pad 2).

The top ring 100 holds and presses the substrate W against the polishing pad 2, and the top ring 100 and the polishing pad 2 rotate while a polishing liquid is being supplied so that the substrate W is polished.

When the polishing of the substrate W is performed, not only the substrate W but also the bottom surface of the retainer ring 40 is worn out. For example, the inner circumference side of the retainer ring 40 is gradually worn out such that the retainer ring 40 has a shape inclined to a certain degree, as illustrated in FIG. 1B1. Thereafter, the retainer ring 40 will not be worn out so much. Depending on polishing conditions such as the polishing pad 2 and the kind of polishing liquid used at the time of polishing, there is a case in which the outer circumference side is worn out such that the retainer ring 40 has a shape inclined in the direction opposite to that in FIG. 1B1, as illustrated in FIG. 1B2. Alternatively, as illustrated in FIG. 1B3, there is also a case in which the inner and outer circumference sides of the retainer ring 40 are extremely worn out such that the retainer ring 40 becomes a downwardly convex shape.

As described above, the new retainer ring 40 suffers from a change in shape (especially, the shape of the bottom surface) as illustrated in FIG. 1A and FIGS. 1B1 to 1B3. Because the polishing characteristic of the substrate W depends on the shape of the retainer ring 40, the polishing characteristic of the substrate W is also changed depending on the shape change of the retainer ring 40. Accordingly, the polishing characteristic is not stabilized while the shape of the retainer ring 40 is being changed. In addition, when the retainer ring 40 becomes a state of any of FIGS. 1B1 to 1B3, and thus, the shape is not changed so much, the polishing characteristic of the substrate W is also stabilized.

That is, the change in the shape of the bottom surface of the retainer ring 40 is a main factor of causing the polishing characteristic of the substrate W to be unstable right after the exchange of the retainer ring 40. For that reason, the shape of the bottom surface of the retainer ring 40 may be formed as illustrated in FIGS. 1B 1 to 1B3 from the beginning.

Figure 3:
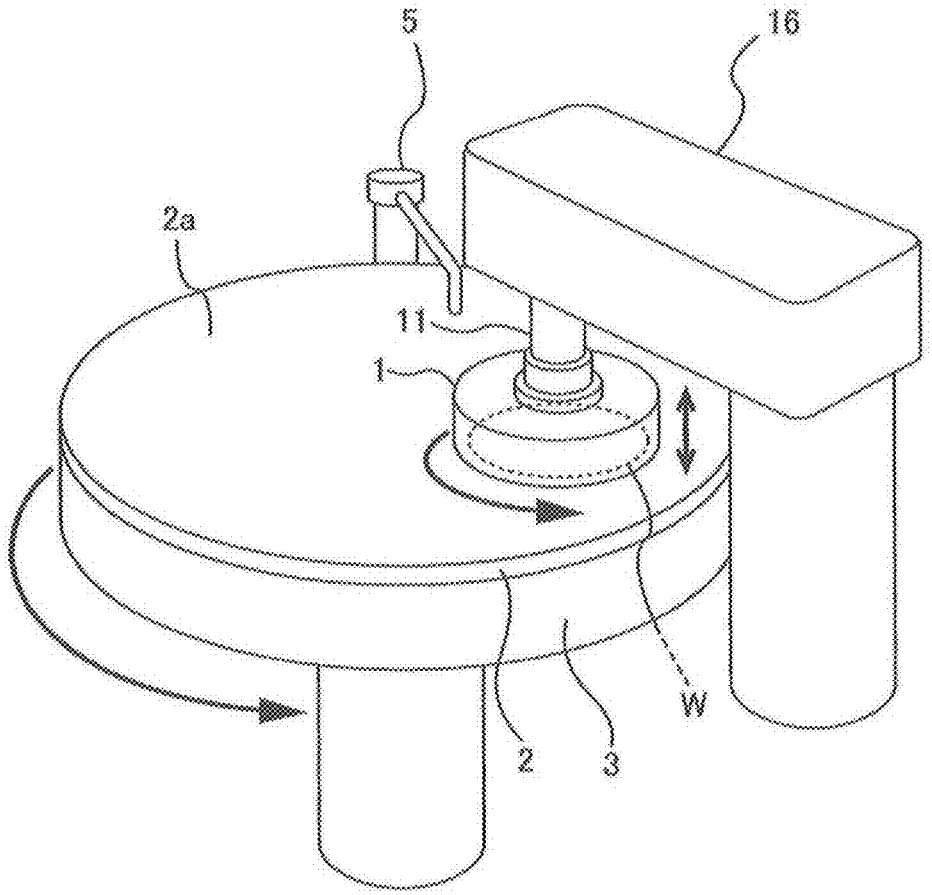

Thus, it is also conceivable to manufacture various kinds of retainer rings 40, which have a bottom surface formed in any of the shapes illustrated in FIGS. 1B1 to 1B3 from the beginning. However, because the retainer rings 40 are consumable parts, the risk of erroneous use and the management costs are increased when there are many kinds of retainer rings 40.

Thus, in the present exemplary embodiment, the retainer ring 40, which is a consumable part, is formed to have a common shape in which the bottom surface is horizontal as illustrated in FIG. 1A, and the shape of, for example, the drive ring 46, which is not a consumable part, is conceived. In this way, the bottom surface of the retainer ring 40 is made to have a desired shape as illustrated in any of FIGS. 1B1 to 1B3 in order to stabilize the polishing characteristic of the substrate W.

Hereinafter, exemplary embodiments of the present disclosure will be described in detail with reference to the accompanying drawings.

First Exemplary Embodiment

In the first exemplary embodiment, the bottom surface of a retainer ring 40 is formed into a desired shape by the shape of a drive ring 46.

FIGS. 2A to 2D are views each schematically illustrating a cross-section of a top ring 1 according to the first exemplary embodiment. Hereinafter, descriptions will be made, especially focusing on a difference between FIG. 1A, FIGS. 1B1 to 1B3 and FIGS. 2A to 2D. Here, the drive ring 46 is made of, for example, a metal, and is hard. Meanwhile, the retainer ring 40 is made of an engineering plastic such as, for example, polyphenylene sulfide (PPS) or polyetheretherketone (PEEK), and has a rigidity lower than that of the drive ring 46 such that the retainer ring 40 is deformable. In addition, in a state where the retainer ring 40 is not fixed to the drive ring 46, the surface of the retainer ring 40 at the polishing pad 2 side is flat and does not have a convex portion as illustrated in FIG. 1A.

Figure 2A:
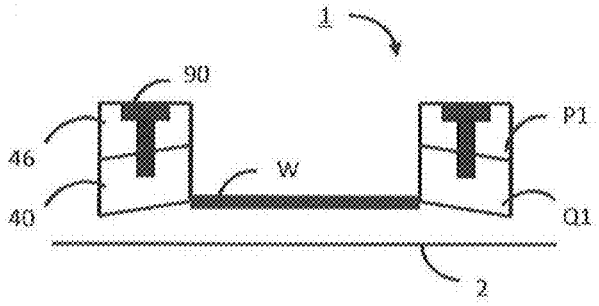
FIGS. 2A to 2D are views each schematically illustrating a cross-section of a top ring 1 according to a first exemplary embodiment.

In FIG. 2A, the bottom surface of the drive ring 46 is inclined to approach the polishing pad 2 from the inner circumference side toward the outer circumference side. In other words, the bottom surface of the drive ring 46 has a convex portion apex P1 at the outermost circumference. In addition, the drive ring 46 and the retainer ring 40 are rigidly fixed to each other by screws 90.

In a state where the retainer ring 40 is not fixed to the drive ring 46, the bottom surface of the retainer ring 40 is horizontal and does not have a convex portion as illustrated in FIG. 1A. Upon being fixed to the drive ring 46 by the screws 90, the retainer ring 40 is deformed according to the shape of the drive ring 46, and as a result, the bottom surface of the retainer ring 40 is inclined to approach the polishing pad 2 side from the inner circumference side toward the outer circumference side. That is, as in FIG. 1B1, the bottom surface of the retainer ring 40 may be formed into a shape that has a convex portion apex Q1 at the outermost circumference.

Figure 2B:
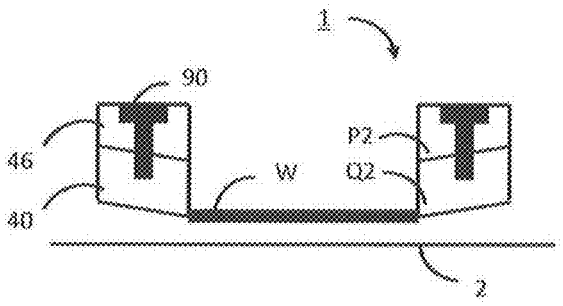

In FIG. 2B, the bottom surface of the drive ring 46 is inclined to approach the polishing pad 2 from the outer circumference side toward the inner circumference side. In other words, the bottom surface of the drive ring 46 has a convex portion apex P2 at the innermost circumference. In this case, the bottom surface of the retainer ring 40 is inclined to approach the polishing pad 2 side from the outer circumference side toward the inner circumference side. That is, as in FIG. 1B2, the bottom surface of the retainer ring 40 may be formed into a shape that has a convex portion apex Q2 at the innermost circumference.

Figure 2C:
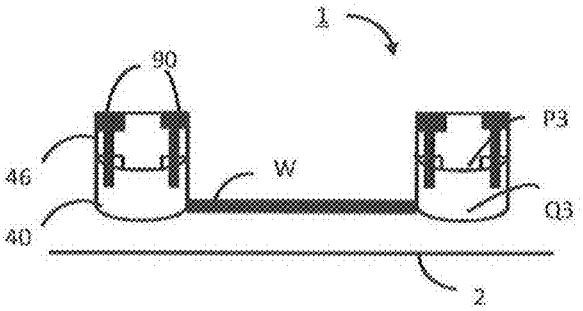

In FIG. 2C, the bottom surface of the drive ring 46 has a rectangular convex portion P3 that is convex downward. In this case, the retainer ring 40 has a convex portion Q3 below the convex portion P3 of the drive ring 46, and is curved to be away from the polishing pad 2 side from the convex portion Q3 toward the outer circumference side and the inner circumference side. That is, as in FIG. 1B3, the bottom surface of the retainer ring 40 may be formed into a shape that has a convex portion at a position other than the outermost circumference and the innermost circumference.

Meanwhile, in the case of FIG. 2C, the screws 90 may also be provided plurally in a radial direction (for example, in two areas outside the convex portions P3, Q3 and inside the convex portions P3, Q3). In this way, the outer circumference side and the inner circumference side of the retainer ring 40 may be deformed more suitably according to the shape of the drive ring 46. In addition, the convex portion P3 of the drive ring 46 is not necessarily formed at the center between the outermost circumference and the innermost circumference, and may be formed at any position.

Figure 2D:
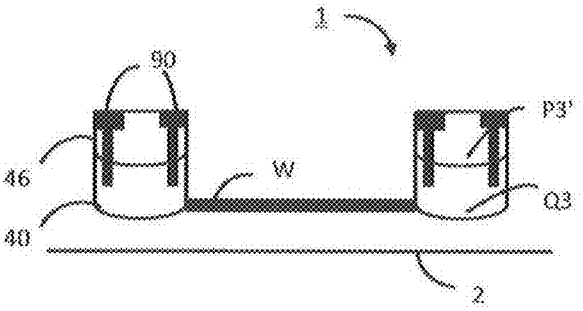

In addition, as illustrated in FIG. 2D, a convex portion P3' formed on the bottom surface of the drive ring 46 may be formed in a shape curved over a portion or the entire range from the outermost circumference to the innermost circumference of the bottom surface, rather than in the rectangular shape.

As described above, the present exemplary embodiment uses a drive ring 46 having a bottom surface which is non-parallel with the polishing pad 2 (in other words, which has a convex portion P1, P2, P3, or P3'). In addition, the shape of the bottom surface of the retainer ring 40 is deformed according to the shape (especially, the shape of the bottom surface) of the drive ring 46 by fixing the drive ring 46 and the retainer ring 40 to each other using screws 90. The bottom surface of the retainer ring 40 may be formed into a desired shape by properly designing the shape of the drive ring 46.

As a specific example, the bottom surface of the drive ring 46 is made to have a convex portion at a position other than the innermost circumference. In this way, the bottom surface of the retainer ring 40 may be formed into a shape having a convex portion at a position other than the innermost circumference (see, e.g., FIGS. 2A, 2C, and 2D).

Meanwhile, although not illustrated, in the inner circumference side and/or outer circumference side of the screws 90, a seal member (e.g., an O-ring) may be interposed between the drive ring 46 and the retainer ring 40 in order to suppress the infiltration of the polishing liquid. This feature is also applied to exemplary embodiments to be described below.

Herein, the "convex portion" may include a shape that is inclined such that the end becomes an apex as in FIGS. 2A and 2B, a rectangular shape like the drive ring 46 in FIG. 2C, and a curved shape that does not have a corner as in FIG. 2D, and when the end of the convex becomes an apex, it is particularly referred to as a convex portion apex.

Hereinafter, a substrate polishing apparatus including the top ring 1 will be described in detail.

FIG. 3 is a view schematically illustrating a substrate polishing apparatus. As illustrated in FIG. 3, the substrate polishing apparatus includes a top ring (substrate holding device) 1 configured to hold and rotate a substrate W (e.g., a semiconductor wafer), a polishing table 3 configured to support a polishing pad 2, and a polishing liquid supply nozzle 5 configured to supply a polishing liquid (slurry) to the polishing pad 2. The top surface of the polishing pad 2 forms a polishing surface 2*a* to polish the substrate W.

The top ring 1 is configured to hold the substrate W on the bottom surface thereof by vacuum suction. The top ring 1 and the polishing table 3 rotate in the same direction as indicated by arrows, and in this state, the top ring 1 presses the substrate W against the polishing surface 2*a* of the polishing pad 2. The polishing liquid is supplied onto the polishing pad 2 from the polishing liquid supply nozzle 5, and the substrate W is polished by sliding contact with the polishing pad 2 in the presence of the polishing liquid.

Figure 4:
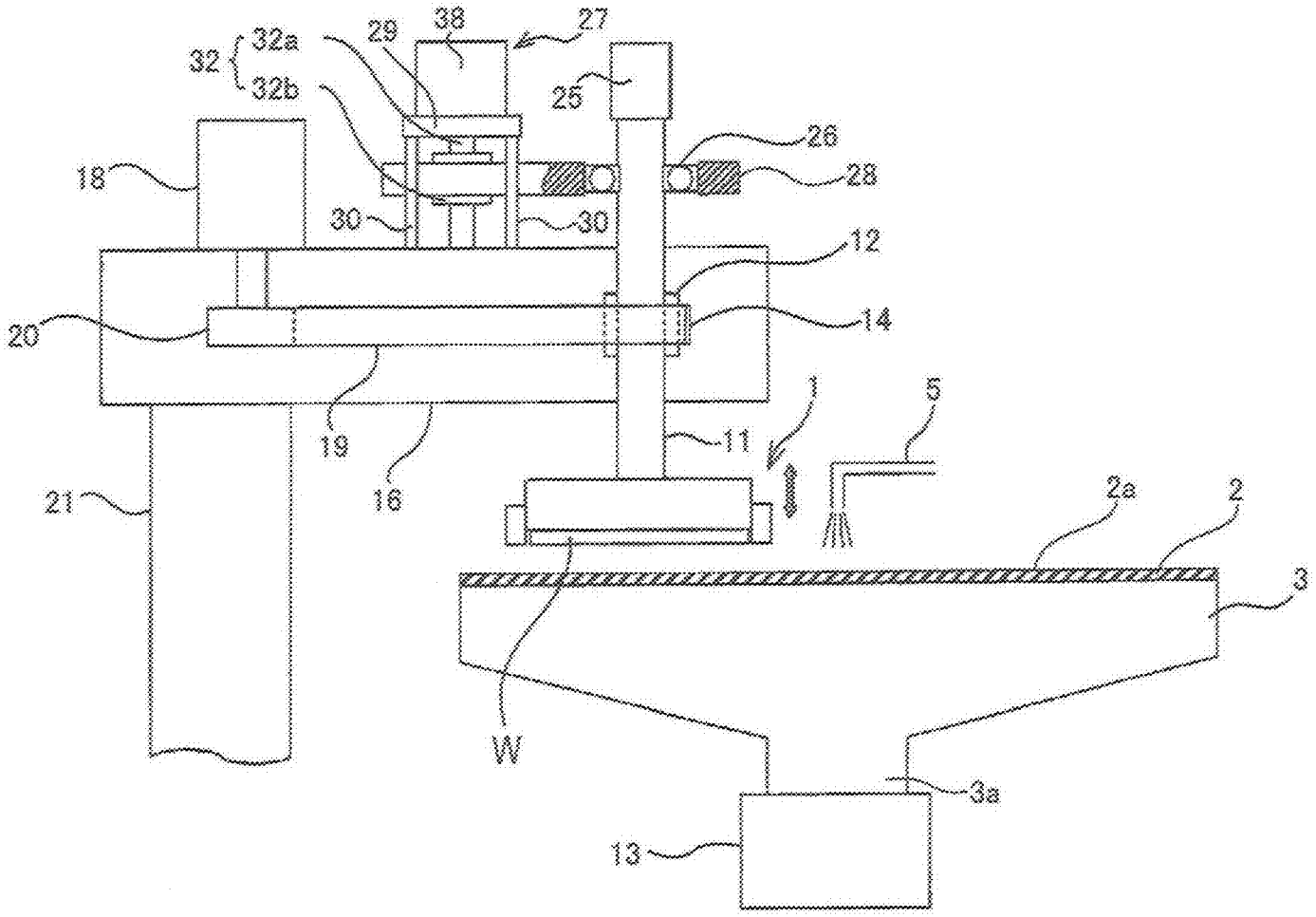
FIG. 4 is a view illustrating a detailed configuration of the substrate polishing apparatus.

FIG. 4 is a view illustrating a detailed configuration of the substrate polishing apparatus. The polishing table 3 is connected, through a table shaft 3*a*, to a table motor 13 which is disposed below the polishing table 3, and configured to be rotatable about the table shaft 3*a*. The polishing pad 2 is attached to the top surface of the polishing table 3. When the polishing table 3 is rotated by the table motor 13, the polishing surface 2*a* is relatively moved with respect to the top ring 1. Accordingly, the table motor 13 constitutes a polishing surface moving mechanism that moves the polishing surface 2*a* in a horizontal direction.

The top ring 1 is connected to a head shaft 11, and the head shaft 11 is configured to be vertically movable with respect to a head arm 16 by a vertical movement mechanism 27. The entire top ring 1 is lifted to be positioned with respect to the head arm 16 by the vertical movement of the head shaft 11. A rotary joint 25 is attached to the upper end of the head shaft 11.

The vertical movement mechanism 27 configured to vertically move the head shaft 11 and the top ring 1 includes a bridge 28 configured to rotatably support the head shaft 11 via a bearing 26, a ball screw 32 attached to the bridge 28, a support base 29 supported by a column 30, and a servo motor 38 provided on the support base 29. The support base 29 configured to support the servo motor 38 is fixed to the head arm 16 via the column 30.

The ball screw 32 includes a screw shaft 32*a* connected to the servo motor 38, and a nut 32*b* screw-coupled to the screw shaft 32*a*. The head shaft 11 is configured to vertically move integrally with the bridge 28. Accordingly, when the servo motor 38 is driven, the bridge 28 moves vertically via the ball screw 32, which causes the head shaft 11 and the top ring 1 to move vertically.

In addition, the head shaft 11 is connected to a rotary cylinder 12 via a key (not illustrated). The rotary cylinder 12 includes a timing pulley 14 on the outer periphery thereof. A head motor 18 is fixed to the head arm 16, and the timing pulley 14 is connected to a timing pulley 20 provided on the head motor 18 via the timing belt 19. Accordingly, when the head motor 18 is rotationally driven, the rotary cylinder 12 and the head shaft 11 are integrally rotated via the timing pulley 20, the timing belt 19, and the timing pulley 14 such that the top ring 1 is rotated about the axial center thereof. The head motor 18, the timing pulley 20, the timing belt 19, and the timing pulley 14 constitute a polishing head rotating mechanism that rotates the top ring 1 about the axial center thereof. The head arm 16 is supported by a head arm shaft 21 that is rotatably supported on a frame (not illustrated).

The top ring 1 is configured to hold the substrate W on the bottom surface thereof. The head arm 16 is configured to be pivotable about the head arm shaft 21, and the top ring 1, which holds the substrate W on the bottom surface thereof, moves from a substrate W reception position to a position above the polishing table 3 by the pivoting of the head arm 16. The top ring 1 and the polishing table 3 are individually rotated, and the polishing liquid is supplied onto the polishing pad 2 from the polishing liquid supply nozzle 5 installed above the polishing table 3. The top ring 1 is lowered, and the substrate W is pressed against the polishing surface 2*a* of the polishing pad 2. In this way, the surface of the substrate W is polished by causing the substrate W to come in sliding contact with the polishing surface 2*a* of the polishing pad 2.

Figure 5:
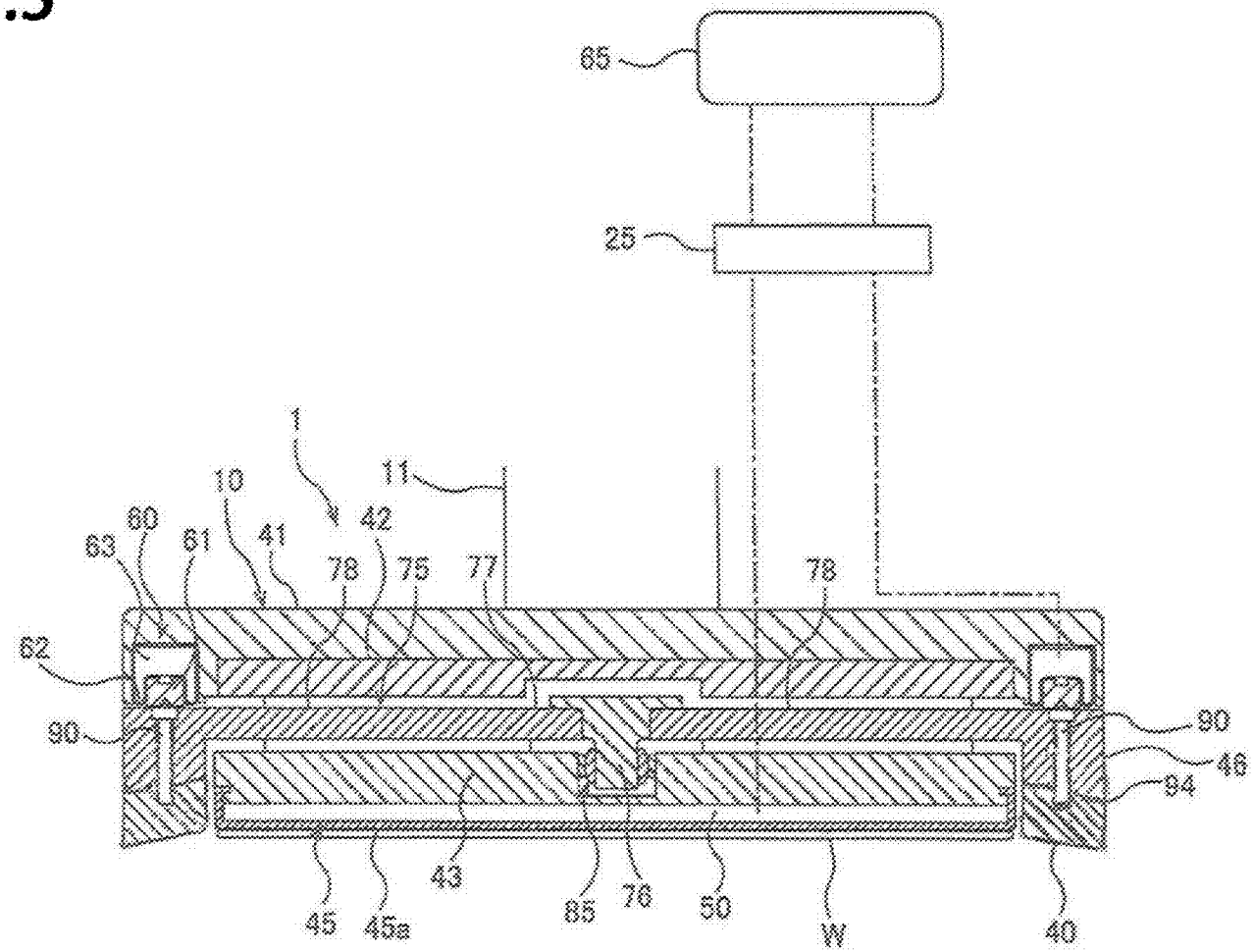
FIG. 5 is a sectional view illustrating the top ring 1.

Next, descriptions will be made on the top ring 1 that constitutes the substrate holding device. FIG. 5 is a sectional view illustrating the top ring 1. As illustrated in FIG. 5, the top ring 1 includes a head body 10 configured to press the substrate W against the polishing surface 2*a*, and a retainer ring 40 arranged to enclose the substrate W. The head body 10 is rotated by the rotation of the head shaft 11. In addition, the rotation of the head shaft 11 is transmitted to the retainer ring 40 by the drive ring 46 such that the retainer ring 40 is also rotated by the rotation of the head shaft 11. That is, the head body 10 and the retainer ring 40 are configured to integrally rotate by the rotation of the head shaft 11. The retainer ring 40 is configured to vertically movable independently from the head body 10.

The head body 10 includes a circular flange 41, a spacer 42 attached to the bottom surface of the flange 41, and a carrier 43 attached to the bottom surface of the spacer 42. The flange 41 is connected to the head shaft 11. The carrier 43 is connected to the flange 41 via the spacer 42, and the flange 41, the spacer 42, and the carrier 43 are integrally rotated and further vertically moved. The flange 41, the spacer 42, and the carrier 43 are formed of a resin such as, for example, an engineering plastic (e.g., PEEK). Meanwhile, the flange 41 may be formed of a metal (e.g., steel use stainless (SUS) or aluminum).

An elastic film 45 is attached to the bottom surface of the carrier 43 so as to come in contact with the rear surface of the substrate W. The bottom surface of the elastic film 45 forms the substrate contact surface 45*a* to come in contact with the substrate W. A pressure chamber 50 is formed between the carrier 43 and the elastic film 45. The pressure chamber 50 is connected to the pressure control device 65 via the rotary joint 25, and configured to be supplied with a compressed fluid (e.g., compressed air) from the pressure control device 65. The elastic film 45 is formed of a rubber material that is excellent in strength and endurance (e.g., ethylene propylene rubber (EPDM), polyurethane rubber, or silicon rubber).

The pressure chamber 50 is also connected to an atmosphere opening mechanism (not illustrated) so that the pressure chamber 50 may also be opened to the atmosphere. The pressure chamber 50 is also connected to a vacuum pump. A plurality of through holes (not illustrated) are formed in the substrate contact surface 45*a* of the elastic film 45. When the pressure chamber 50 is evacuated by the vacuum pump so that vacuum is formed within the pressure chamber 50, the substrate contact surface 45*a* may hold the substrate W by a vacuum suction. When polishing the substrate W, the compressed fluid (e.g., compressed air) is supplied into the pressure chamber 50. The substrate W is pressed against the polishing surface 2*a* of the polishing pad 2 by the substrate contact surface 45*a* of the elastic film 45.

The retainer ring 40 is arranged around the substrate contact surface 45*a* of the elastic film 45. The retainer ring 40 is connected to the drive ring 46 by the screws 90. During the polishing of the substrate W, the retainer ring 40 presses the polishing surface 2*a* of the polishing pad 2 while enclosing the substrate W which is compressed against the polishing pad 2 by the substrate contact surface 45*a*. The substrate W is held within the top ring 1 by the retainer ring 40, such that the substrate is prevented from falling out of the top ring 1.

The upper portion of the drive ring 46 is connected to an annular retainer ring pressing mechanism 60. The retainer ring pressing mechanism 60 applies uniform downward load to the entire top surface of the drive ring 46 such that the entire bottom surface of the retainer ring 40 is pressed against the polishing surface 2*a* of the polishing pad 2.

The retainer ring pressing mechanism 60 includes an annular piston 61 fixed to the upper portion of the drive ring 46 and an annular rolling diaphragm 62 connected to the top surface of the piston 61. A retainer ring pressure chamber 63 is formed inside the rolling diaphragm 62. The retainer ring pressure chamber 63 is connected to the pressure control device 65 via the rotary joint 25. When the compressed fluid (e.g., compressed air) is supplied to the retainer ring pressure chamber 63 from the pressure control device 65, the rolling diaphragm 62 pushes the piston 61 downward, and the piston 61 pushes the whole of the drive ring 46 and the retainer ring 40 downward. In this way, the retainer ring pressing mechanism 60 presses the bottom surface of the retainer ring 40 against the polishing surface 2*a* of the polishing pad 2. In addition, the whole of the drive ring 46 and the retainer ring 40 may be moved upward by forming a negative pressure within the retainer ring pressure chamber 63 by the pressure control device 65. The retainer ring pressure chamber 63 is also connected to the atmosphere opening mechanism (not illustrated) so that the retainer ring pressure chamber 63 may also be opened to the atmosphere.

The drive ring 46 is removably connected to the retainer ring pressing mechanism 60. More specifically, the piston 61 is formed of a magnetic material such as a metal, and a plurality of magnets (not illustrated) are arranged on the upper portion of the drive ring 46. The magnets draw the piston 61 such that the drive ring 46 is fixed to the piston 61 by the magnetic force. The piston 61 and the drive ring 46 may be mechanically connected to each other by, for example, a fastening member without using the magnetic force. The drive ring 46 may be connected to a spherical bearing 85 via a connection member 75. The spherical bearing 85 is arranged radially inside the retainer ring 40.

Figure 6:
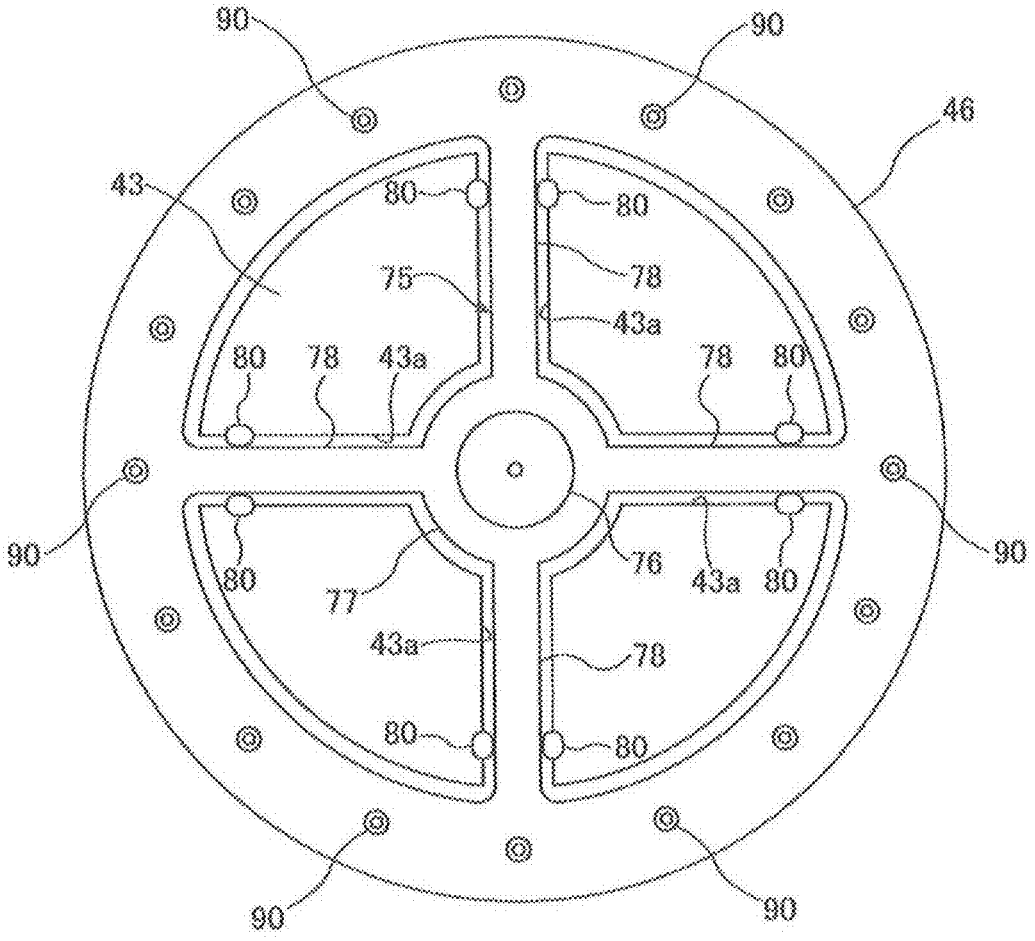
FIG. 6 is a plan view illustrating a drive ring 46 and a connection member 75.

FIG. 6 is a plan view illustrating the drive ring 46 and the connection member 75. As illustrated in FIG. 6, the connection member 75 includes a shaft portion 76 arranged at the central portion of the head body 10, a hub 77 fixed to the shaft portion 76, and a plurality of spokes 78 radially extending from the hub 77. One end of each of the spokes 78 is fixed to the hub 77, and the other end is fixed to the drive ring 46. The hub 77, the spokes 78 and the drive ring 46 are integrally formed. The drive ring 46 may be constituted as a member that is separate from the spokes 78.

A plurality of pairs of driving rollers 80 are fixed to the carrier 43. The driving rollers 80 of each pair are arranged at the opposite sides of each spoke 78 to be in rolling contact with the opposite surfaces of each spoke 78. The rotation of the carrier 43 is transmitted to the spokes 78 via the driving rollers 80 such that the drive ring 46 connected to the spokes 78 is rotated. Accordingly, the retainer ring 40 fixed to the drive ring 46 is rotated integrally with the head body 10.

As illustrated in FIG. 5, the shaft portion 76 extends in the vertical direction within the spherical bearing 85. The shaft portion 76 of the connection member 75 is supported on the spherical bearing 85 arranged in the central portion of the head body 10 to be movable in the vertical direction. As illustrated in FIG. 6, a plurality of radial recesses 43*a* is formed in the carrier 43 so as to accommodate the spokes 78, respectively, and the spokes 78 are adapted to be movable in the vertical direction in the recesses 43*a*, respectively.

With this arrangement, the drive ring 46 connected to the connection member 75 and the retainer ring 40 are adapted to be movable in the vertical direction with respect to the head body 10. In addition, the drive ring 46 and the retainer ring 40 are supported to be tiltable by the spherical bearing 85. The retainer ring 40 is configured to be relatively tiltable and vertically movable with respect to the substrate contact surface 45*a* and the substrate W pressed against the substrate contact surface 45*a*, and further to be capable of pressing the polishing pad 2 independently from the substrate W.

The retainer ring 40 is fixed to the drive ring 46 by the screws 90. That is, through holes and screw holes are formed in the drive ring 46 and the retainer ring 40, respectively, at regular intervals along the circumferential direction. In addition, the screws 90 extend to the retainer ring 40 through the through holes of the drive ring 46, and are inserted into the screw holes of the retainer ring 40, respectively.

In the present exemplary embodiment, as illustrated in FIG. 5, the bottom surface of the drive ring 46 is inclined (corresponding to FIG. 2A). As a result, upon being fixed to the drive ring 46 by the screws 90, the retainer ring 40 is deformed such that the bottom surface of the retainer ring 40 is inclined. A drive ring 46 having a shape corresponding to that illustrated in FIG. 2B or FIG. 2C may be provided.

As described above, in the first exemplary embodiment, the shape of the bottom surface of the drive ring 46 is formed non-parallel with the polishing pad 2, and the drive ring 46 is rigidly connected to the retainer ring 40. Then, the bottom surface of the retainer ring 40 is formed into a shape to which the shape of the bottom surface of the drive ring 46 is reflected. By using this, the bottom surface of the retainer ring 40 may be formed into a desired shape. Accordingly, a shape of any of FIGS. 1B 1 to 1B3 may be obtained just after the retainer ring 40 is exchanged with a new one, and thus, the initial polishing characteristic may be stabilized. As a result, initialization using a dummy wafer may be reduced, and in some cases, may become unnecessary.

Second Exemplary Embodiment

A second exemplary embodiment to be described next is to deform the retainer ring 40 substantially over the entire circumference thereof using an annular support ring.

Figure 7A:
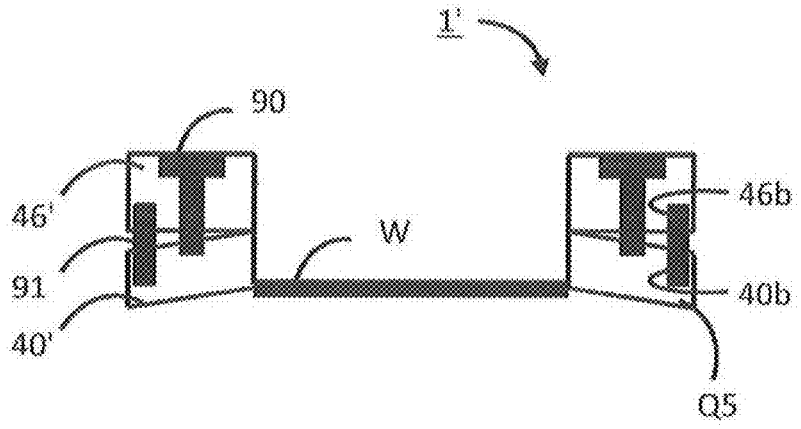
FIGS. 7A to 7C are views each schematically illustrating a cross-section of a top ring 1' according to a second exemplary embodiment.
Figure 7B:
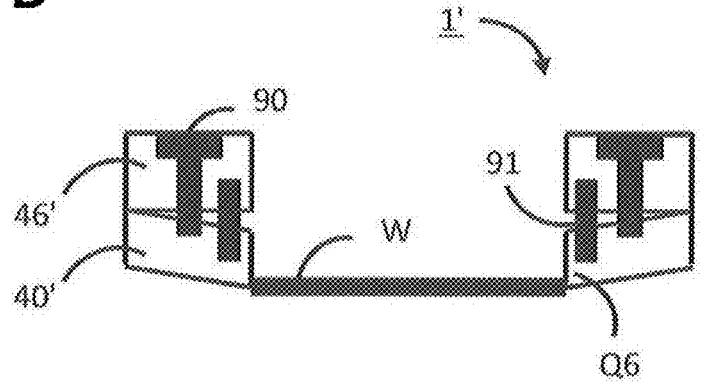
Figure 7C:
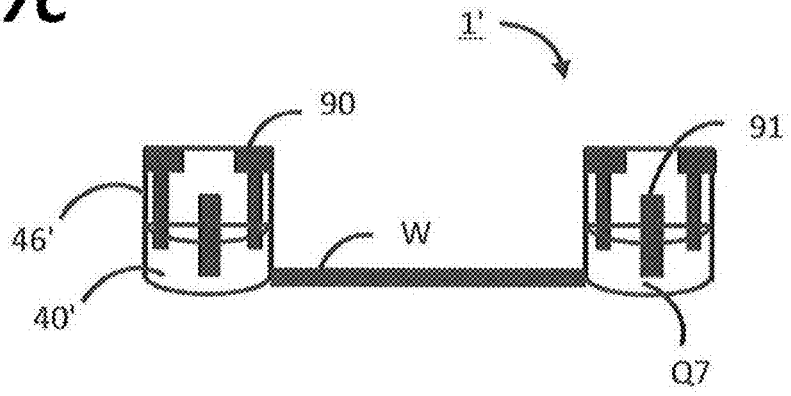

FIGS. 7A to 7C are views each schematically illustrating a cross-section of a top ring 1' according to the second exemplary embodiment. In the present exemplary embodiment, the bottom surface of the drive ring 46' may be horizontal. In addition, the top ring 1' of the present exemplary embodiment includes an annular support ring 91 as a shim. As illustrated in FIG. 7A, the support ring 91 is sandwiched between the drive ring 46' and the retainer ring 40'. More specifically, the upper portion of the support ring 91 is inserted into an annular recess 46*b* (an inserted portion) formed in the vicinity of the outer circumference of the drive ring 46' to be in contact with the drive ring 46', and the lower portion of the support ring 91 is inserted into an annular recess 40*b* (an inserted portion) formed in the vicinity of the outer circumference of the retainer ring 40' to be in contact with the retainer ring 40'.

In addition, the length of the support ring 91 is longer than the sum of the depth of the recess 46*b* of the drive ring 46' and the depth of the recess 40*b* of the retainer ring 40'. For that reason, the vicinity of the outer circumference of the retainer ring 40' is pressed and deformed due to the length of the support ring 91 (the vertical length) such that the bottom surface of the retainer ring 40' is formed into a shape having a convex portion apex Q5 at the outermost circumference thereof.

Meanwhile, as illustrated in FIG. 7B, in a case where the recess of the retainer ring 40' is formed in the vicinity of the inner circumference thereof, a convex portion apex Q6 is formed at the innermost circumference of the bottom surface of the retainer ring 40'. In addition, as illustrated in FIG. 7C, in a case where the recess of the retainer ring 40' is formed in the vicinity of the center thereof and screws 90 are provided at the inner circumference side and the outer circumference side thereof, the bottom surface of the retainer ring 40' has a convex portion Q7 formed at a position other than the outermost circumference and the innermost circumference, more specifically, in the vicinity of the center between the outermost circumference and the innermost circumference.

In addition, an annular member other than the support ring 91 may be sandwiched between the drive ring 46' and the retainer ring 40'. For example, over the entire circumference of the annular member, a portion of the annular member may be engaged with the drive ring 46', and another portion may be engaged with the retainer ring 40'.

In this way, in the second exemplary embodiment, the retainer ring 40' is deformed depending on the length of the support ring 91 (more specifically, a relationship between the length of the support ring 91 and the depths of the recesses 46*b*, 40*b*). By using this, the bottom surface of the retainer ring 40' may be formed into a desired shape. In addition, the support ring 91 is sandwiched between the drive ring 46' and the retainer ring 40' over the entire circumference thereof. For that reason, the bottom surface of the retainer ring 40' may be made uniform as compared with a case in which the bottom surface of the retainer ring 40' is discretely deformed by, for example, screws.

Third Exemplary Embodiment

The above-described second exemplary embodiment fixes the drive ring 46 to the retainer ring 40 using the screws 90. On the contrary, a third exemplary embodiment to be described next is to fix both of the drive ring 46 and the retainer ring 40 over the entire circumference thereof.

Figure 8:
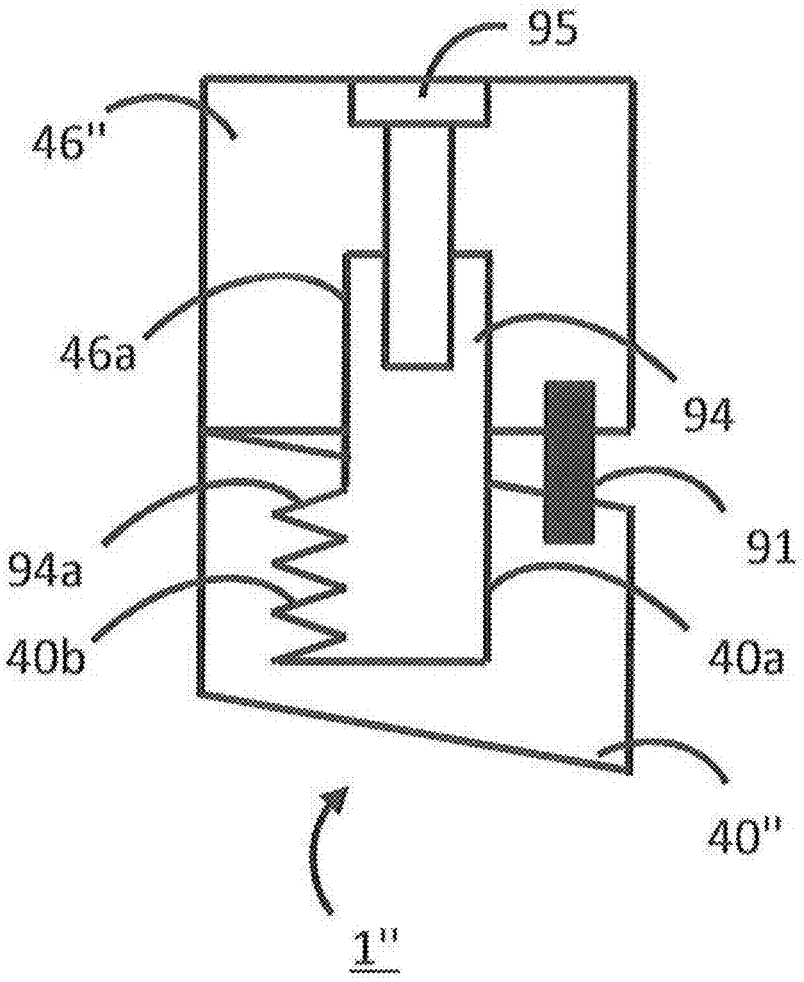
FIG. 8 is a view schematically illustrating a cross-section of a top ring 1" according to a third exemplary embodiment.

FIG. 8 is a view schematically illustrating a cross-section of a top ring 1" according to the third exemplary embodiment. FIG. 8 corresponds to FIG. 7A. On the bottom surface (the surface at the retainer ring 40" side) of the drive ring 46", an annular concave portion 46*a* is formed over the entire circumference thereof. In addition, on the top surface (the surface at the drive ring 46" side) of the retainer ring 40", an annular concave portion 40*a* is formed over the entire circumference thereof at a position facing the concave portion 46*a* of the drive ring 46". On the inner side surface of the concave portion 40*a*, female threads 40*b* are formed in the circumferential direction.

An annular screw ring 94 is fitted in the concave portions 40*a*, 46*a*. That is, the upper portion of the screw ring 94 is embedded in the concave portion 46*a* of the drive ring 46", and the lower portion of the screw ring 94 is protruded into the concave portion 40*a* of the retainer ring 40".

The screw ring 94 is fixed to the drive ring 46" by a screw 95. In addition, male threads 94*a* are formed on the lower portion of the screw ring 94 in the circumferential direction, and are engaged with the female threads 40*b* of the retainer ring 40" such that the screw ring 94 is also fixed to the retainer ring 40". Accordingly, the drive ring 46" and the retainer ring 40" are fixed to each other by the screw ring 94.

Meanwhile, the screw ring 94 may be partially interrupted without necessarily extending over the entire circumference. A seal member (not illustrated) such as, for example, an O-ring may be provided between the drive ring 46" and the retainer ring 40" at the inner circumference side and/or outer circumference side as compared to the screw ring 94.

As described above, in the third exemplary embodiment, the drive ring 46" and the retainer ring 40" are fixed to each other by the screw ring 94 that extends substantially over the entire circumference. For that reason, the bottom surface of the retainer ring 40 may be made uniform as compared to the case where the drive ring and the retainer ring are discretely fixed using screws 90.

Meanwhile, the screw ring 94 may also be used for the top rings 1, 1' illustrated in FIGS. 2A to 2D and FIGS. 7B and 7C, instead of the screws 90.

Fourth Exemplary Embodiment

In a fourth exemplary embodiment to be described next, a double-structured retainer ring (i.e., a retainer ring) is constituted with an inner ring and an outer ring.

Figure 9A:
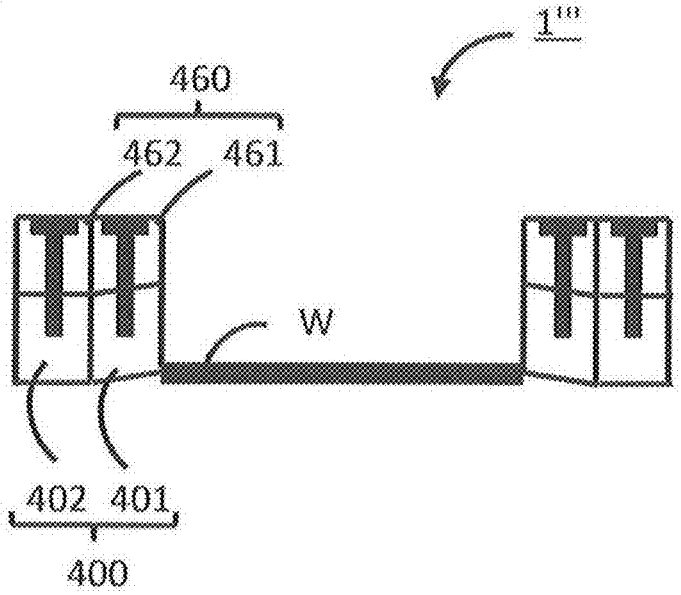
FIGS. 9A and 9B are views each schematically illustrating a cross-section of a top ring 1''' according to a fourth exemplary embodiment.
Figure 9B:
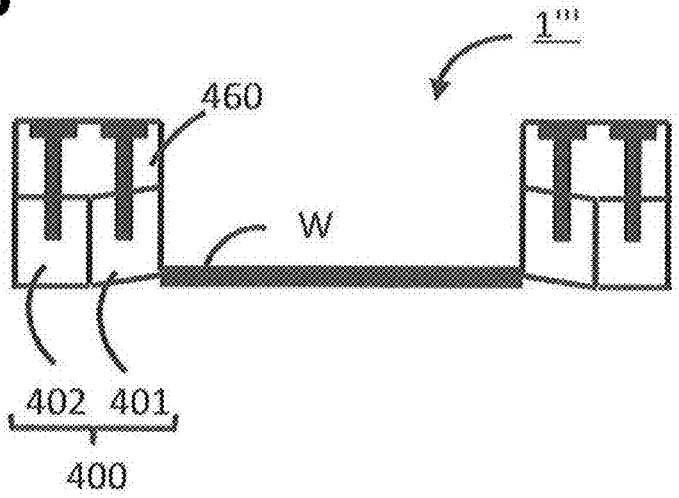

FIGS. 9A and 9B are views each schematically illustrating a cross-section of a top ring 1'" according to a fourth exemplary embodiment. Because FIGS. 9A and 9B illustrate a modification of the top ring 1 illustrated in FIGS. 2A to 2D, a difference between the top ring 1'" of FIGS. 9A and 9B and the top ring 1 of FIGS. 2A to 2D will be mainly described. As illustrated in FIGS. 9A and 9B, the retainer ring 400 of the present exemplary embodiment includes an inner retainer ring 401 and an outer retainer ring 402. The inner retainer ring 401 is configured to hold the peripheral edge of the substrate W, and the outer retainer ring 402 is provided outside the inner retainer ring 401.

The inner retainer ring 401 and the outer retainer ring 402 may be different from each other in material and property. For example, the inner retainer ring 401, which comes in direct contact with the substrate W, may be formed of a material lower in hardness than that of the outer retainer ring 402 in order to prevent the damage of the substrate W. In addition, the outer retainer ring 402, which is pressed against the polishing pad, may be formed of a material higher in wear-resistance that that of the inner retainer ring 401. As a specific example, the inner retainer ring 401 may be made of a resin, and the outer retainer ring 402 may be made of a metal. In addition, the inner retainer ring 401 and the outer retainer ring 402 may be configured such that the vertical positions thereof may be independently adjusted.

The drive ring 460 illustrated in FIG. 9A includes an inner drive ring 461 and an outer drive ring 462. The inner drive ring 461 and the outer drive ring 462 are fixed to the inner retainer ring 401 and the outer retainer ring 402, respectively.

In addition, as in the first exemplary embodiment, the bottom surface of the inner retainer ring 401 and/or the bottom surface of the outer retainer ring 402 may be deformed according to the shape of the bottom surface of the inner drive ring 461 and/or the shape of the bottom surface of the outer drive ring 462. That is, the bottom surface of the inner drive ring 461 and/or the bottom surface of the outer drive ring 462 may have a convex portion such that the bottom surface of the inner retainer ring 401 and/or the bottom surface of the outer retainer ring 402 may be formed into a desired shape.

As an example of FIG. 9A, the convex portion may be formed at a proper position on the inner drive ring 461 and/or the outer drive ring 462 such that a convex portion apex may be provided at the innermost circumference of the inner retainer ring 401, a convex portion apex may be provided at the outermost circumference of the inner retainer ring 401 (i.e., a position where the inner retainer ring 401 is in contact with the outer retainer ring 402), a convex portion apex may be provided at the outermost circumference of the outer retainer ring 402, or a convex portion apex may be provided at the innermost circumference of the outer retainer ring 402 (i.e., a position where the outer retainer ring 402 is in contact with the inner retainer ring 401).

In addition, in a case where the shape of the inner retainer ring 401, which is closer to the substrate W, has a great effect on the polishing characteristic of the substrate W, only the inner drive ring 461 may be made to have a convex portion on the bottom surface thereof.

The drive ring 460 illustrated in FIG. 9B is fixed to both the inner retainer ring 401 and the outer retainer ring 402. The bottom surface of the inner retainer ring 401 and/or the bottom surface of the outer retainer ring 402 may be made to have a convex portion at an arbitrary position by the shape of the bottom surface of the drive ring 460.

Figure 10A:
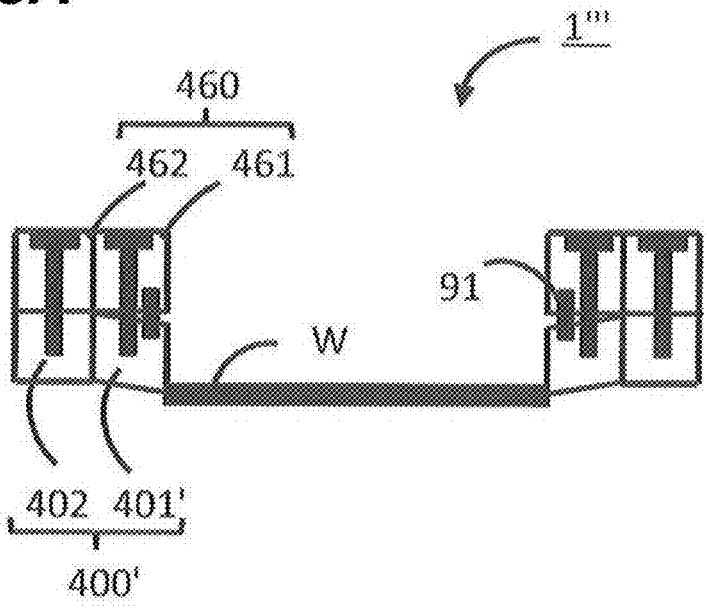
FIGS. 10A and 10B are views each schematically illustrating a cross-section of the top ring 1''' according to the fourth exemplary embodiment.
Figure 10B:
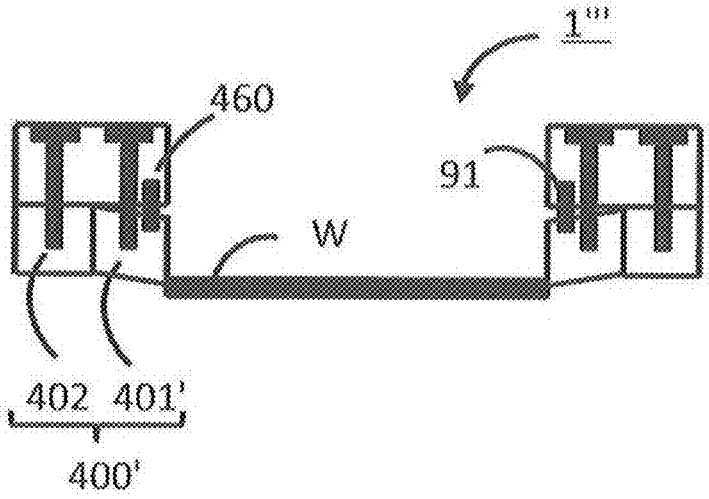

FIGS. 10A and 10B are views each schematically illustrating a cross-section of the top ring 1'" according to the fourth exemplary embodiment. Because FIGS. 10A and 10B illustrate a modification of the top ring 1' illustrated in FIGS. 7A to 7C, a difference between the top ring 1'" of FIGS. 10A and 10B and the top ring 1' of FIGS. 7A to 7C will be mainly described.

As in FIG. 9A, the drive ring 460 illustrated in FIG. 10A includes an inner drive ring 461 and an outer drive ring 462. In addition, the inner retainer ring 401' is deformed by a support ring 91 inserted into the inner drive ring 461 and the inner retainer ring 401'. Of course, the outer retainer ring 402 may be made to be deformed by inserting the support ring 91 into the outer drive ring 462 and the outer retainer ring 402. Further, both the inner retainer ring 401' and the outer retainer ring 402 may be made to be deformed. This may cause a convex portion to be formed at an arbitrary position on the bottom surface of the retainer ring 400'.

In FIG. 10B, both the inner retainer ring 401' and the outer retainer ring 402 are fixed to one drive ring 460, as in FIG. 9B. Also, a convex portion may be formed at an arbitrary position on the bottom surface of the retainer ring 400' by the support ring 91.

In this way, in the fourth exemplary embodiment, the bottom surface of a retainer ring 40 may be formed into a desired shape in the case where a double-structured retainer ring 400, 400', which includes the inner retainer ring 401' and the outer retainer ring 402, is used. For that reason, the initial polishing characteristic may be stabilized.

Meanwhile, in the above-described second to fourth exemplary embodiments, the support ring 91, which is an annular member, may be easily removed or exchanged from the top ring 1. The shape of the exchangeable support ring 91 may be properly determined according to the shape of the bottom surface of a used retainer ring 40' (the retainer ring 40" or the retainer ring 400'; the same shall apply hereinafter). That is, the shape of the support ring 91 may be determined such that, when a new retainer ring 40' is fixed to the drive ring 46', the shape of the bottom surface of the new retainer ring 40' becomes similar to the shape of the used retainer ring 40'.

For example, in the case where a small convex portion is formed in the vicinity of the center of the bottom surface of the used retainer ring 40, a somewhat longer support ring 91 in FIG. 7C may be used.

As another example, in the case where a large convex portion is formed in the vicinity of the center of the bottom surface of the used retainer ring 40', a considerably longer support ring 91 in FIG. 7C may be used.

A support ring 91 having an optimum length (i.e., a support ring that makes the shape of the bottom surface of the new retainer ring 40' similar to the shape of the used retainer ring 40' when the new retainer ring 40' is fixed to the drive ring 46') may be fabricated every time, or an optimum one (i.e., a support ring that makes the shape of the bottom surface of the new retainer ring 40' most similar to the shape of the used retainer ring 40' when the new retainer ring 40' is fixed to the drive ring 46') may be selected and used among a plurality of support rings 91 prepared beforehand and having different lengths.

In addition, for example, in a case where the drive ring 46 is exchangeable, the shape of the drive ring 46 may be properly determined according to the shape of the bottom surface of the used retainer ring 40. Further, in a case where the position of the support ring 91 may be selected from, for example, FIGS. 7A to 7C, the position may be determined.

From the foregoing, it will be appreciated that various exemplary embodiments of the present disclosure have been described herein for the purpose of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A substrate holding device used in a substrate polishing apparatus that polishes a substrate using a polishing pad, the substrate holding device comprising:

a retainer ring configured to hold a peripheral edge of the substrate; and a drive ring configured to be fixed to the retainer ring to rotate together with the retainer ring, wherein a surface of the drive ring, being in contact with the retainer ring, has a convex portion, a surface of the retainer ring at an opposite side to the surface of the drive ring has a convex portion at a position other than an innermost circumference, wherein the convex portion of the retainer ring has a corresponding shape to that of the convex portion of the drive ring.

2. The substrate holding device of claim 1, wherein the drive ring is fixed to a surface of the retainer ring at a side opposite to the polishing pad side, and a surface of the drive ring at a retainer ring side has a convex portion at a position other than an innermost circumference thereof such that the surface of the retainer ring at the polishing pad side has a convex portion.

3. The substrate holding device of claim 1, further comprising:

a fixing member configured to fix the drive ring and the retainer ring.

4. The substrate holding device of claim 1, wherein the retainer ring is made of material which has a rigidity lower than that of the drive ring such that the retainer ring is deformable.

5. The substrate holding device of claim 4, wherein, upon being fixed to the drive ring, the retainer ring is deformed such that the surface of the retainer ring at the polishing pad side has a convex portion.

6. The substrate holding device of claim 1, wherein the drive ring is a non-consumable part and the retainer ring is a consumable part.

7. The substrate holding device of claim 1, wherein, in response to being fixed to the drive ring, the retainer ring is deformed such that the surface of the retainer ring has the corresponding shape.

8. The substrate holding device of claim 1, wherein the retainer ring does not have the convex portion when the retainer ring is not fixed to the drive ring.

9. A substrate polishing apparatus comprising:

a polishing pad;

a substrate holding device configured to hold a substrate, and including:

a retainer ring configured to hold a peripheral edge of the substrate, and a drive ring configured to be fixed to the retainer ring to rotate together with the retainer ring, wherein a surface of the drive ring, being in contact with the retainer ring, has a convex portion, a surface of the retainer ring at an opposite side to the surface of the drive ring has a convex portion at a position other than an innermost circumference, wherein the convex portion of the retainer ring has a corresponding shape to that of the convex portion of the drive ring.

10. The substrate polishing apparatus of claim 9, wherein, in response to being fixed to the drive ring, the retainer ring is deformed such that the surface of the retainer ring has the corresponding shape.

11. The substrate polishing device of claim 9, wherein the retainer ring does not have the convex portion when the retainer ring is not fixed to the drive ring.

* * * * *